US006622934B1

(12) United States Patent
Sanada et al.

(10) Patent No.: US 6,622,934 B1
(45) Date of Patent: Sep. 23, 2003

(54) LIQUID SPRAYING APPARATUS

(75) Inventors: Kazuo Sanada, Kanagawa (JP); Tsutomu Takatsuka, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 258 days.

(21) Appl. No.: 09/255,699

(22) Filed: Feb. 23, 1999

(30) Foreign Application Priority Data

Mar. 18, 1998 (JP) ..... 10-068210

(51) Int. Cl.[7] ..... B67D 5/38

(52) U.S. Cl. ..... 239/74; 209/71; 209/63; 209/102.2

(58) Field of Search ..... 239/102.2, 63, 239/71, 74, 99, 101

(56) References Cited

U.S. PATENT DOCUMENTS

| | | | | | |
|---|---|---|---|---|---|
| 1,927,495 | A | * | 9/1933 | Hilgerink | 239/74 |
| 3,679,132 | A | * | 7/1972 | Vehe et al. | 239/102.2 |
| 3,701,476 | A | * | 10/1972 | Houser | 239/102.2 |
| 3,869,476 | A | * | 3/1975 | Thies et al. | 260/345.2 |
| 3,882,508 | A | * | 5/1975 | Stoneburner | 239/102.2 |
| 4,324,117 | A | * | 4/1982 | Schwob et al. | 239/102.2 |
| 4,367,736 | A | * | 1/1983 | Gupton | 128/214 E |
| 4,368,478 | A | * | 1/1983 | Koto | 346/140 R |
| 4,498,088 | A | * | 2/1985 | Kanayama | 346/140 R |
| 4,533,082 | A | * | 8/1985 | Maehara et al. | 239/102.2 |
| 4,545,650 | A | * | 10/1985 | Kirkman et al. | 350/357 |
| 5,163,617 | A | * | 11/1992 | Clifford et al. | 239/102.2 |
| 5,354,999 | A | * | 10/1994 | Neff | 250/573 |
| 5,487,378 | A | * | 1/1996 | Robertson et al. | 128/200.16 |
| 5,505,777 | A | * | 4/1996 | Ciardella et al. | 239/102.1 |
| 5,950,691 | A | * | 9/1999 | Abe et al. | 141/103 |
| 5,964,326 | A | * | 10/1999 | Lee et al. | 188/352 |
| 5,991,019 | A | * | 11/1999 | Saner et al. | 356/300 |

FOREIGN PATENT DOCUMENTS

| | | |
|---|---|---|
| JP | 9-179273 | 7/1997 |

* cited by examiner

*Primary Examiner*—Christopher Kim
(74) *Attorney, Agent, or Firm*—Sughrue Mion, PLLC

(57) ABSTRACT

When a liquid tank of a liquid spraying apparatus is filled with a liquid, after the liquid has been supplied into the spray tank of the liquid spraying apparatus, if the existence of residual bubbles is detected by a bubble detecting device, an operation is carried out in which the liquid inside the spray tank is drained so as to drain out the bubbles from the tank and the spray tank is refilled with a liquid. As a result, residual bubbles inside the spray tank are removed from the spray tank and the liquid can be applied appropriately to a photosensitive material without causing atomization failure.

5 Claims, 14 Drawing Sheets

LIQUID SPRAYING APPARATUS

BACKGROUND OF THE INVENTION

1. Field of the Invention

The present invention relates to a liquid spraying apparatus which sprays an image forming solvent as a liquid onto image recording materials such as a photosensitive material and an image receiving material.

2. Description of the Related Art

Generally, an image forming apparatus using a laser exposure heat developing and transferring system (i.e., a silver salt photographing system) is used. In such an image forming apparatus, prints are output in the processing steps as shown in FIG. 14. First, in an exposure processing step, image processing is carried out on an image data input signal by a CPU 500. The signal which has been subjected to the image processing is transmitted to a semi-conductor unit 502.

In this semi-conductor unit 502, by using a laser (LD) light source, a three-color simultaneous exposure process is carried out on the exposure surface of a donor piece 506 which has been pulled out from a donor roll 504 onto which a donor material is wound in the form of a roll, and cut to a predetermined length. By this exposure process, silver halide contained in the donor piece 506 reacts with the light source, a static image is formed, and fed to a water application step.

In this water application step, a predetermined, small amount of water is uniformly applied to the surface of the donor piece 506 by a liquid spraying apparatus 508, and the donor piece 506 having water thus applied thereto is fed to a heat developing and color image transferring step.

In this heat developing and color image transferring step, in a state in which an image receiving paper strip 512 (an OHP film or the like can also be used) which has been pulled out and cut to a predetermined length from an image receiving paper roll 510, and the donor piece 506 onto which water is applied are laminated with each other, the laminated image receiving paper strip 512 and the donor piece 506 are heated by a heating device 514. Therefore, a developing process is carried out on the donor piece 506, while dyes on the donor piece 506 are transferred to the image receiving paper strip 512, and fixed thereto. Accordingly, an image on the donor piece 506 is transferred to the image receiving paper strip 512. After this transferring operation has been completed, the laminated image receiving paper strip 512 and donor piece 506 are fed to a peel-off step.

In this peel-off step, the donor piece 506 which has been used, and the image receiving paper strip 512 onto which an image has been transferred are peeled off from each other, the donor piece 506 is then abandoned, and the image receiving paper strip 512 is finished as a high quality color print, and thereby outputted.

Conventionally, as a liquid spraying apparatus 508 which is used for such an image forming apparatus as described above, a liquid spraying apparatus has been proposed. In this apparatus, in order to uniformly apply a small amount of water to the surface of the donor piece 506, a nozzle plate in which a number of small nozzle holes are punched is disposed at the bottom of a sealed water tank to which water is supplied from outside. A small columnar actuator is provided at a predetermined distance from the nozzle plate in the lengthwise direction thereof. The nozzle plate is vibrated by driving the actuator, the water in the water tank, as water droplets, is sprayed from the nozzle holes of the nozzle plate to the outside.

In the above-described liquid spraying apparatus 508, at the beginning of use of the apparatus, water is supplied from a water supplying pipe and the internal portion of an empty water tank is filled with the water. During the operation of spraying water onto the donor piece 506, the same amount of water is supplied from the water supplying pipe to the sealed type water tank as that lost each time it is sprayed so that the water pressure in the tank can be kept constant. Further, when the operation of applying water to the donor piece 506 by means of the liquid spraying apparatus 508 has been completed, water in the water tank is drained from a drain pipe so that water leakage from the nozzle holes is prevented when the liquid spraying apparatus 508 is not in use.

In such a liquid spraying apparatus which has been proposed conventionally as described above, during use thereof, when an empty water tank is filled with water, the internal wall of the water tank may be deposited with bubbles, and some of these may remain as residual bubbles.

In this way, if residual bubbles exist inside the sealed type water tank, when the nozzle plate is vibrated by driving the actuator, and the nozzle plate moves in the direction in which the pressure in the water tank increases, the volume of the bubbles contracts so as to absorb the pressure in the water tank. Or when the nozzle plate moves in the direction in which the pressure in the water tank decreases, the volume of the bubbles expands so as to absorb the pressure in the water tank. Accordingly, pressure loss is caused. As a result, there are drawbacks in that the pressure for pressurizing the water in the sealed type water tank by the nozzle plate decreases, water cannot be pushed out and sprayed from the nozzle holes, and atomization failure may be caused.

SUMMARY OF THE INVENTION

In view of the aforementioned facts, it is an object of the present invention to provide a liquid spraying apparatus in which, when a liquid tank having a nozzle plate is filled with a liquid, the internal portion of the liquid tank is prevented from being deposited with residual bubbles, and a liquid can be sprayed appropriately from the liquid tank without causing atomization failure.

In accordance with a first aspect of the present invention, there is provided a liquid spraying apparatus in which a nozzle plate, which is provided at a portion of the wall surface of a spray tank which stores a liquid therein, and which has a row of nozzles made up of a plurality of nozzle holes through which a liquid is sprayed, is reciprocated so that the liquid inside the spray tank is pressurized and sprayed from the plurality of nozzle holes, comprising: a bubble detecting means which, when the spray tank is filled with a liquid, detects whether residual bubbles exist inside the spray tank.

Since the present invention is structured as described above, at the start of using the liquid spraying apparatus, when the spray tank is filled with a liquid, if residual bubbles exist inside the spray tank, the bubble detecting means detects that residual bubbles exist in the spray tank. In this case, for example, by a user performing a manual operation in which a liquid is drained from the spray tank so as to drain out residual bubbles therefrom and the spray tank is refilled with a liquid, residual bubbles are removed from the spray tank, and without causing atomization failure, a liquid can be sprayed appropriately from the spray tank.

In accordance with a second aspect of the present invention, there is provided a liquid spraying apparatus in which a nozzle plate, which is provided at a portion of the wall surface of a spray tank which stores a liquid therein, and which has a row of nozzles made up of a plurality of nozzle holes through which a liquid is sprayed, is reciprocated so that the liquid inside the spray tank is pressurized and sprayed from the plurality of nozzle holes, comprising: bubble detecting means which, when the spray tank is filled with a liquid, detects whether or not residual bubbles exist inside the spray tank; and residual bubble prevention and control means which, when receiving a signal indicating that the existence of residual bubbles has been detected by the bubble detecting means, drains the residual bubbles.

Since the present invention is structured as described above, after the spray tank has been filled with a liquid, when the existence of residual bubbles has been detected by the bubble detecting means, a control operation in which the liquid inside the spray tank is drained so as to drain out residual bubbles, and the spray tank is refilled with a liquid is automatically carried out. Alternatively, a control operation comprising: means in which residual bubbles are removed by tilting the spray tank; means in which residual bubbles are removed by decreasing the pressure of the liquid with which the spray tank is filled; and means in which residual bubbles are removed by stirring the liquid with which the spray tank is filled, and the like are carried out automatically. As a result, residual bubbles are removed from the spray tank, and a liquid can be sprayed appropriately from the spray tank without causing atomization failure.

In accordance with a third aspect of the present invention, there is provided a liquid spraying apparatus in which a nozzle plate, which is provided at a portion of the wall surface of a spray tank which stores a liquid therein, and which has a row of nozzles made up of a plurality of nozzle holes through which a liquid is sprayed, is reciprocated so that the liquid inside the spray tank is pressurized and sprayed from the plurality of nozzle holes, comprising: bubble detecting means which, when the spray tank is filled with a liquid, detects whether or not residual bubbles exist inside the spray tank; and residual bubble prevention and control means which, when receiving a signal indicating that the existence of residual bubbles has been detected by the bubble detecting means, carries out a control operation in which the liquid with which the spray tank is filled is drained, and the spray tank is refilled with a liquid.

Since the present invention is structured as described above, after the spray tank has been filled with a liquid, when the existence of residual bubbles has been detected by the bubble detecting means, a control operation is automatically performed in which the liquid with which the spray tank is filled is drained, and the spray tank is refilled with a liquid. As a result, residual bubbles are removed from spray tank, and a liquid can be sprayed appropriately from the spray tank without causing atomization failure.

DESCRIPTION OF THE PREFERRED EMBODIMENTS

Figure 1:
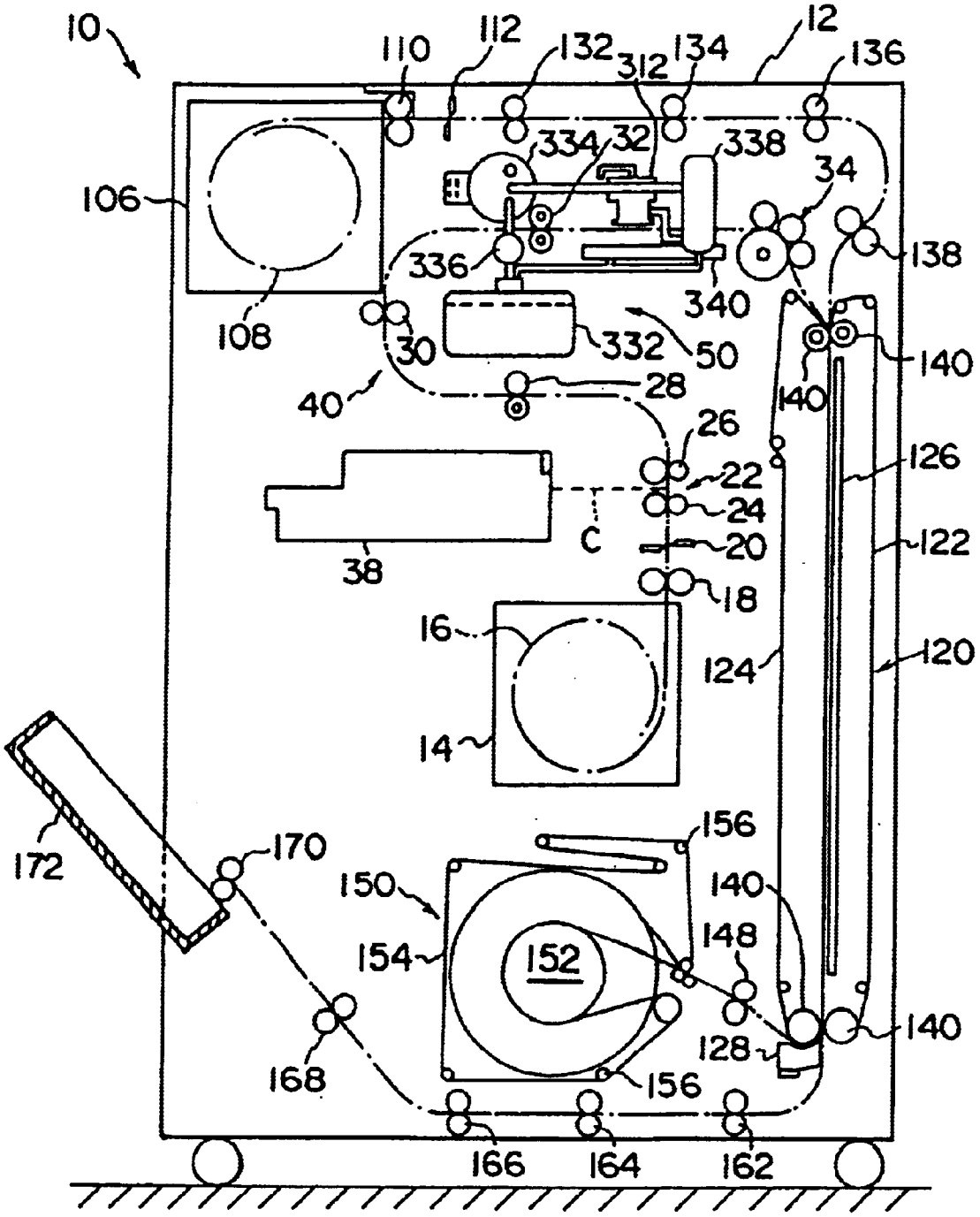
FIG. 1 is a schematic overall structural view of an image recording apparatus having a liquid spraying apparatus according to an embodiment of the present invention.

A schematic overall structural view of an image recording apparatus 10 as an image forming apparatus having a liquid spraying apparatus according to an embodiment of the present invention is shown in FIG. 1.

A photosensitive material magazine 14 which receives a photosensitive material 16 therein is disposed in a housing 12 of the image recording apparatus 10 which is shown in FIG. 1. The photosensitive material 16 is taken up in the photosensitive material magazine 14 in the form of a roll such that the photosensitive (exposure) surface of this photosensitive material 16 which has been pulled out from the photosensitive material magazine 14 faces towards the left of the diagram in FIG. 1.

A pair of nip rollers 18 and a cutter 20 are provided near a photosensitive material output port in the photosensitive material magazine 14, and can cut the photosensitive material 16, which has been pulled out from the photosensitive material magazine 14, to a predetermined length. The cutter 20 is, for example, a rotary type cutter formed of a moving blade and a stationary blade. The cutter 20 can cut the photosensitive material 16 by vertically moving the moving blade via a rotating cam or the like so as to mesh with the stationary blade.

A plurality of pairs of conveying rollers 24, 26, 28, 30, 32, and 34 are sequentially provided on the downstream side of the cutter 20 in the direction in which the photosensitive material 16 is conveyed. A guide plate (not shown) is provided between each of the pairs of the conveying rollers. The photosensitive material 16 which has been cut to a predetermined length is conveyed firstly to an exposure section 22 provided between the pairs of conveying rollers 24 and 26.

An exposure device 38 is provided at the left side of the exposure section 22, and three types of LDs, a lens unit, a polygon mirror, and a mirror unit are disposed therein (none of which is shown). A light beam C is transmitted to the exposure section 22 from the exposure device 38 for the photosensitive material 16 to be exposed.

Further, above the exposure section 22, are provided a U-turn portion 40 through which the photosensitive material 16 is conveyed by being curved into a U-shape, and a water application section 50 which applies an image forming solvent to the photosensitive material 16. In accordance with the present embodiment, water is used as the image forming solvent.

The photosensitive material 16, which has come up from the photosensitive material magazine 14 and which has been exposed at the exposure section 22, is nipped and conveyed by each of the pairs of the conveying rollers 28 and 30, and is fed to the water application portion 50 through the conveying path above the U-turn portion 40.

Figure 2:
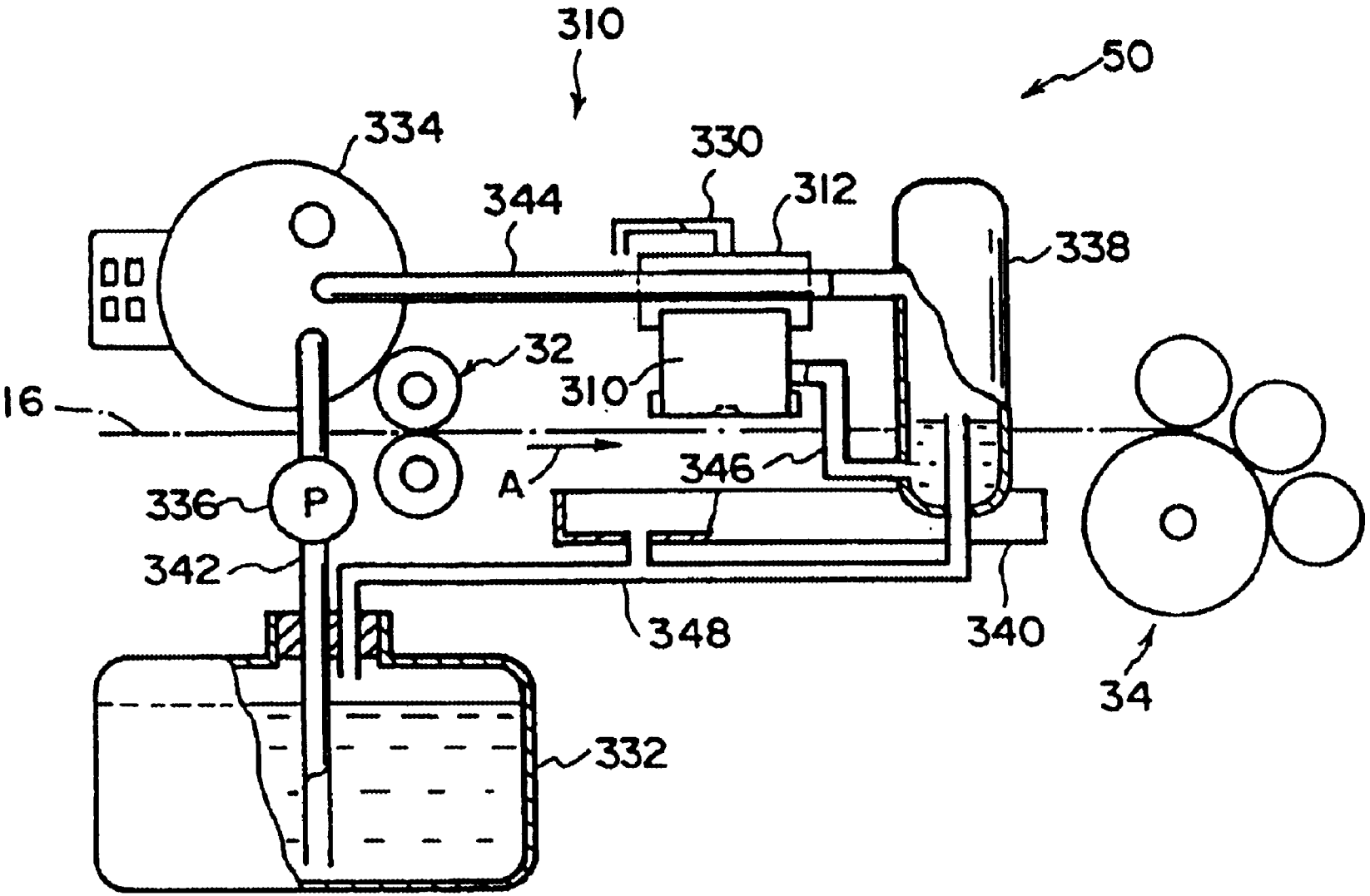
FIG. 2 is a schematic overall structural view of an application device using the liquid spraying apparatus according to the present embodiment.

As shown in FIG. 2, a spray tank 312 which forms a part of an application device 310 which is a liquid spraying apparatus is disposed at a position which is opposite to the conveying path A of the photosensitive material 16 inside the water application section 50.

Further, as shown in FIG. 2, a water bottle 332 for storing the water which is supplied into the spray tank 312 is disposed at the lower left side of the spraying tank 312, and a filter 334 for filtering the water is disposed at an upper portion of the water bottle 332. A water supplying pipe 342, which has a pump 336 disposed midway thereof, connects the water bottle 332 and the filter 334.

Further, a sub-tank 338 for storing water which is supplied from the water bottle 332 is disposed at the right side of the spray tank 312, and a water supplying pipe 344 extends from the filter 334 to the sub-tank 338. Therefore, when the pump 336 is operated, water is supplied from the water bottle 332 to the filter 334, and the water, which has already passed through the filter 334 and been filtered, is supplied into the sub-tank 338 and is temporarily stored therein. A water supplying pipe 346, which connects the sub-tank 338 and a side end portion of the spray tank 312, is disposed therebetween. The spray tank 312 is filled with water which has been pumped from the water bottle 332 by the pump 336, through the filter 334, the sub-tank 338, the water supplying pipe 346, and the like.

A tray 340, which is connected to the water bottle 332 via a circulation pipe 348, is disposed beneath the spray tank 312. The tray 340 accumulates water overflowing the spray tank 312 and returns the water into the water bottle 332 via the circulation pipe 348. Further, the circulation pipe 348 is connected to the sub-tank 338 in a state where the circulation pipe 348 projects and extends into the sub-tank 338. The circulation pipe 348 returns the excessive water which has been accumulated in the sub-tank 338 into the water bottle 332.

Figure 6:
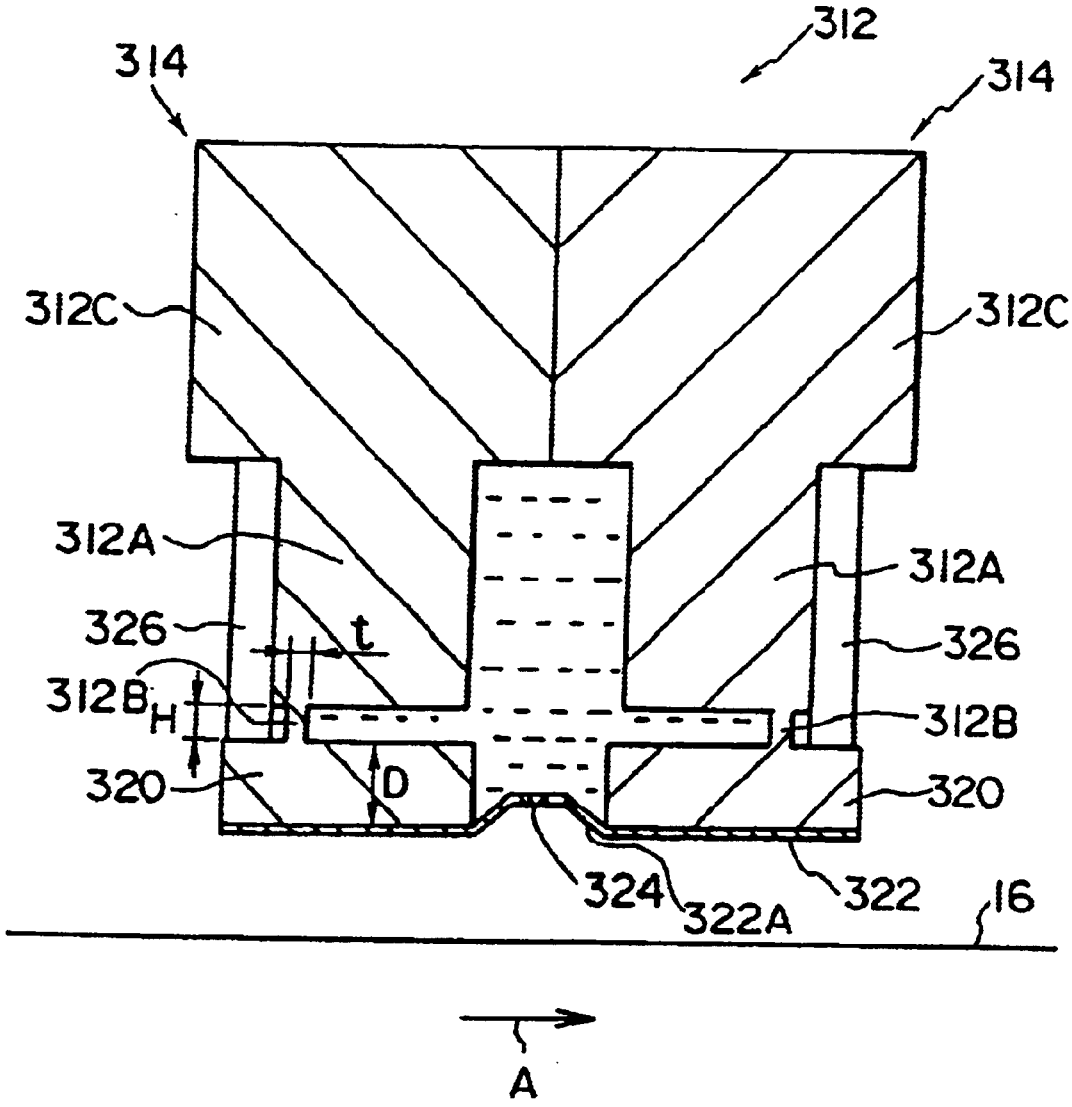
FIG. 6 is a cross sectional view taken along line VI—VI in FIG. 3.
Figure 8:
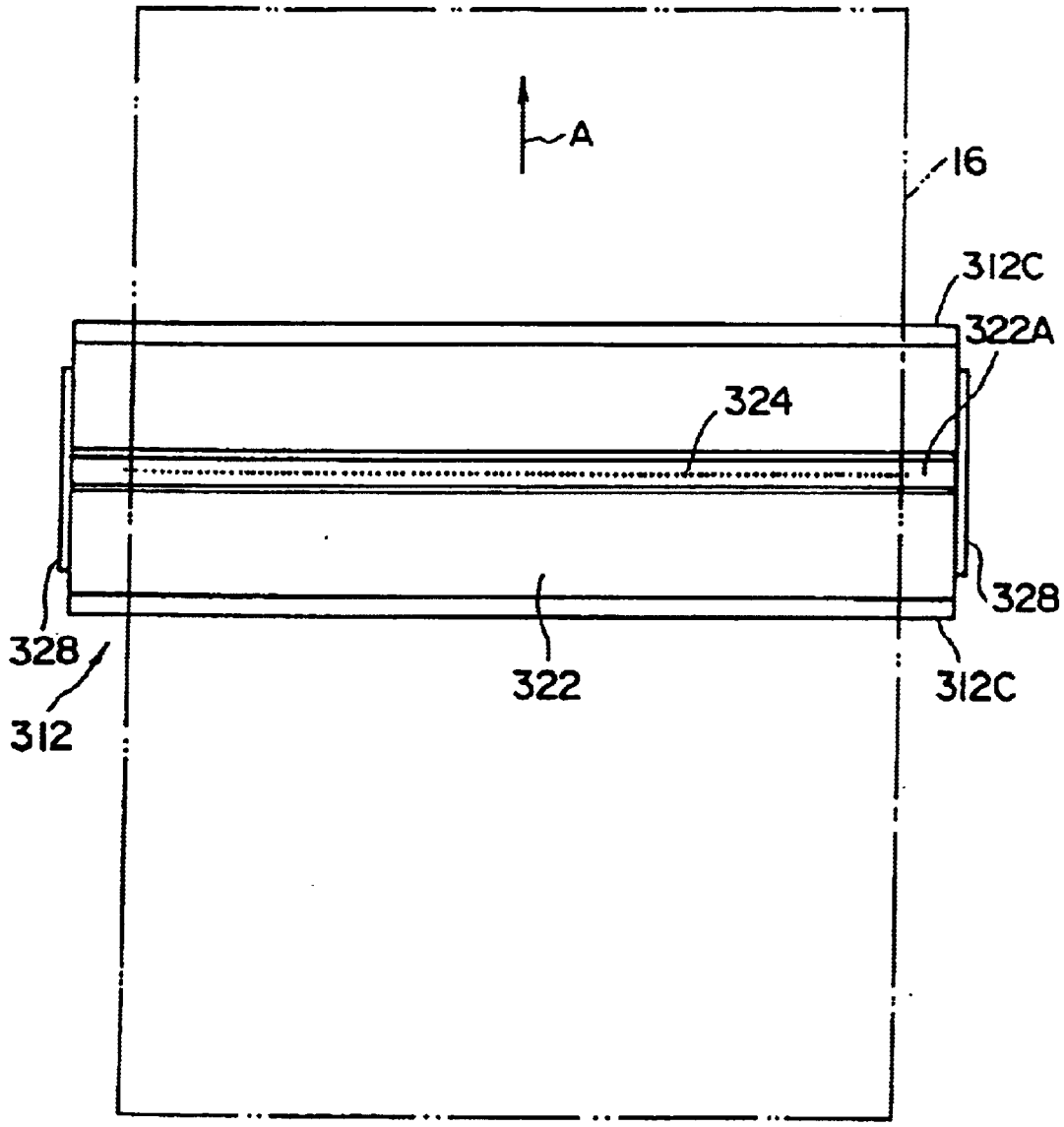
FIG. 8 is a bottom view of the liquid spraying apparatus according to the present embodiment and illustrating the state in which a liquid is sprayed onto a photosensitive material which is being conveyed.

As shown in FIGS. 6 and 8, a nozzle plate 322 made by an elastically deformable, rectangular, and thin plate member (e.g., a thickness of 60 $\mu$m or less) is disposed at a portion which is a bottom wall surface of this spray tank 312 and opposes the conveying path A of the photosensitive material 16.

Figure 7:
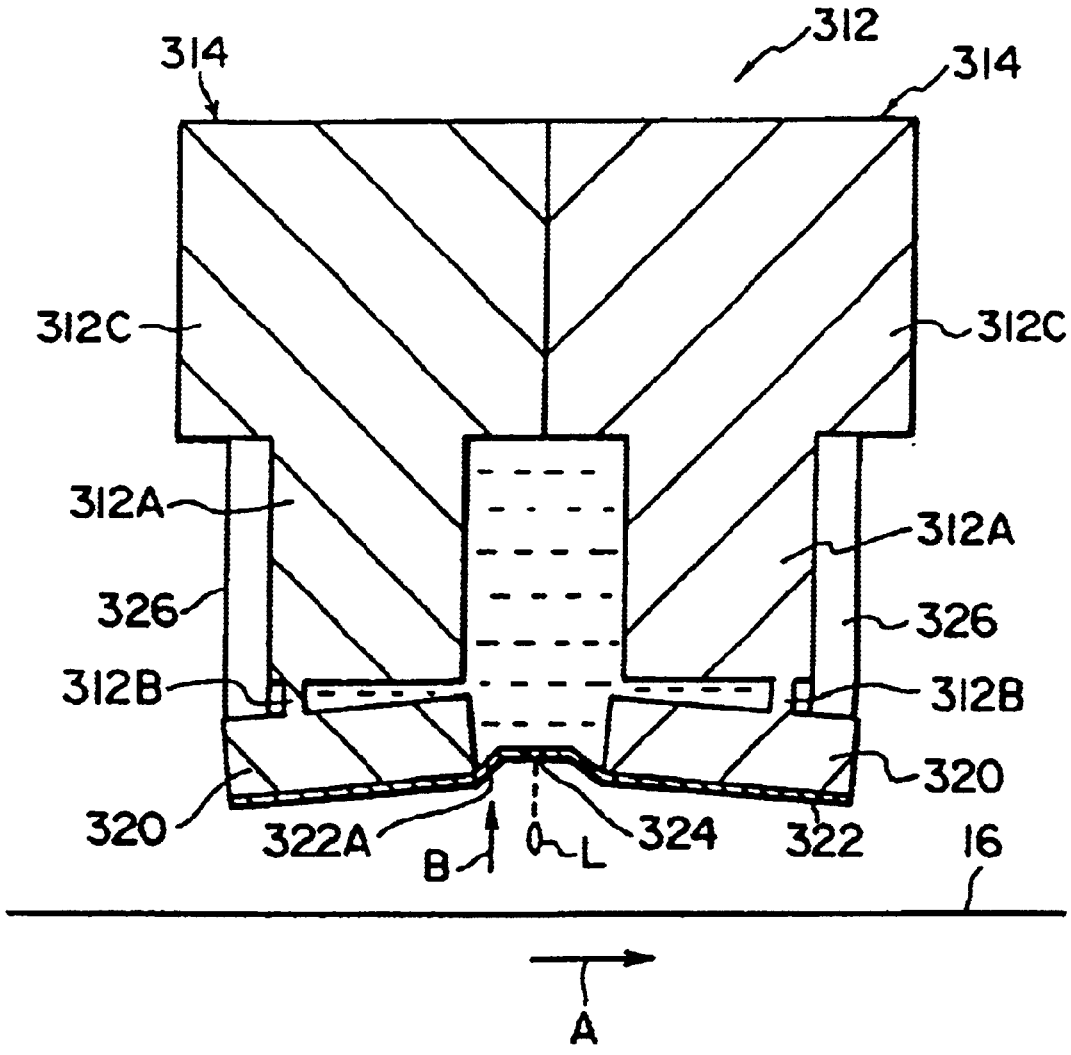
FIG. 7 is a cross sectional view taken along line VI—VI in FIG. 3 at the time of liquid spraying.

Further, as shown in FIGS. 6 to 8, this nozzle plate 322 has a plurality of nozzle holes 324 (each of which has a diameter of 10 $\mu$m to 200 $\mu$m, for example) for spraying water, with which the spray tank 312 has been filled. The nozzle holes 324 form a straight line on this nozzle plate 322 so as to be spaced apart from each other at a predetermined distance along a direction crossing the conveying direction A of the photosensitive material 16, and are disposed so as to extend along the entire widthwise direction of the photosensitive material 16. The plurality of the nozzle holes 324 can be disposed or structured in a single or a plurality of rows. Accordingly, water inside the spray tank 312 is able to be discharged from each of the nozzle holes 324 towards the photosensitive material 16.

In order to increase the rigidity of the nozzle plate 322 in the longitudinal direction thereof in which the plurality of the nozzle holes 324 form a straight line, a groove portion 322A is provided at the nozzle plate 32. The groove portion 322A extends along the direction in which the plurality of the nozzle holes 324 form a straight line, and is formed so as to be bent in a trapezoidal cross sectional concave shape.

Due to the water pressure when water is stored inside the spray tank 312, the water overflowing the nozzle holes 324 is connected between the nozzle holes adjacent to each other. The apparent diameter of a nozzle hole becomes larger so that water leakage may be caused. In order to prevent such water leakage as described above, a water repelling treatment using NiP plating or the like is applied to the bottom surface of the nozzle plate 322, i.e., the external side surface of the spray tank 312.

In order to prevent the deposition of bubbles at the peripheries of the nozzle holes 324, the corner portions of the nozzle plate 322 which are disposed on the internal side of the spray tank 312 and at the peripheries of the nozzle holes 324 are formed in a curved cross sectional configuration, or a hydrophobic treatment is applied thereto.

Figure 3:
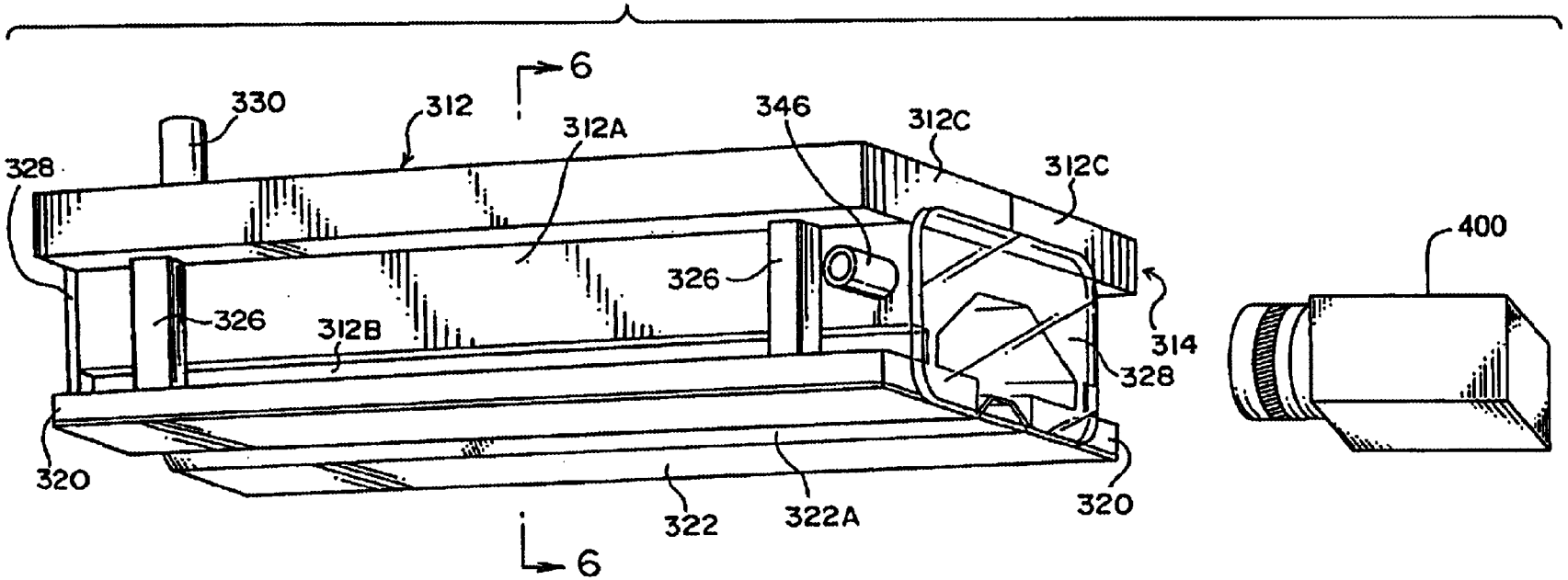
FIG. 3 is an enlarged perspective view of the liquid spraying apparatus according to the present embodiment.

As shown in FIGS. 2 and 3, an exhaust pipe 330 extends from the upper portion of the spray tank 312 on the opposite side to the portion where the water supplying pipe 346 is connected. The exhaust pipe 330 connects the outside and inside portions of the spray tank 312. A valve (not shown) for opening or closing this exhaust pipe 330 is provided midway on the exhaust pipe 330, and the spray tank 312 can be opened or closed to the outside air by the opening or closing movement of this valve.

Both end portions of the nozzle plate 322, being the end portions of the nozzle plate 322 which are positioned in an orthogonal direction with respect to the direction of the row of nozzles made up of the plurality of nozzle holes 324 arranged in a line, are bonded with an adhesive or the like respectively to a pair of lever plates 320, which serve as displacement transmitting members, as is shown in FIG. 6. Through this adhesive bonding, the nozzle plate 322 and the pair of lever plates 320 are connected to each other. The pair of lever plates 320 are fixed respectively to a pair of sidewalls 312A through supporting portions 312B which are sidewalls for connecting the pair of sidewalls 312A of the spray tank 312.

A portion of each of a pair of topwalls 312C, abutting each other and forming the top surface of the spray tank 312, protrudes to the outside of the spray tank 312. A plurality of piezoelectric elements 326 serving as actuators (in this embodiment, two piezoelectric elements are provided on each side) which are extended and driven are bonded and disposed at the lower side of each of these projecting topwalls 312C. The external end side of each of the lever plates 320 is bonded to the lower surface of each of the piezoelectric elements 326, and the piezoelectric elements 326 and the lever plate 320 are connected to each other. Namely, the piezoelectric elements 326 are installed so as to span the distance between the topwalls 312C and the lever plates 320.

Therefore, a lever mechanism can be structured by these piezoelectric elements 326, the lever plates 320, and the supporting portions 312B. When the external end sides of the lever plates 320 are moved by the piezoelectric elements 326, the lever plates 320 are moved so as to be swingable around the supporting portions 312B, and the internal end sides of the lever plates 320 are moved in the opposite direction of this movement. These piezoelectric elements 326 are formed from, for example, laminated piezoceramics. The displacements of the piezoelectric elements in the axial direction are made larger. The piezoelectric elements are connected to a power supply in which the timing of application of a voltage is controlled by a controller (none of which is shown). The aforementioned valve for opening or closing the exhaust pipe 330 is also connected to this controller. The controller controls the opening or closing movement of the valve.

Each of the lever plates 320, the sidewalls 312A, the supporting portions 312B, and the topwalls 312C forms a part of the frames 314 integrated with each other. As shown in FIG. 6, the pair of frames 314 are overlapped and fastened by unillustrated bolts, and the external frame of the spray tank 312 is thereby formed in a state in which each of the pair of lever plates 320, the pair of sidewalls 312A, the pair of topwalls 312C, and the pair of supporting portions 312B are disposed so as to face each other.

The frames 314 are made from metallic materials such as aluminum, brass, magnesium, and the like. Further, as is shown in FIG. 6; the specific sizes of the lever plates 320 and the supporting portions 312B are such that each of the lever plates 320 has a thickness D which ranges from 2 mm to 8 mm, the thickness t of a hinge being the width of each of the supporting portions 312B ranges from 0.2 mm to 1 mm, and the height H of a hinge which is the height of each of the supporting portions 312B ranges from 0.6 mm to 3 mm.

Each of the lever plates 320 itself needs high rigidity so as to move integrally and swingably as a rigid body, and has the thickness D of 2 to 8 mm. Further, if each of the supporting portions 312B has a hinge thickness t which is excessively thin, it becomes difficult to manufacture the supporting portions 312B and it becomes easy to cause a breakage to the same. If each of the supporting portions 312B has a hinge thickness t which is excessively thick, it becomes difficult for the lever plates 320 to move. Further, if each of the supporting portions 312B has a hinge height H which is excessively high, it becomes easy for the supporting portions 312B to fall down. However, provided that the supporting portions 312B and the lever plates 320 have the above-described range of sizes, such problems as described above are not caused.

By forming the lever plates 320 and the supporting portions 312B within the above-described range of sizes, the magnification of the lever mechanism, which is the ratio of the displacement amount of the nozzle plate 322 at the peripheries of the nozzle holes 324 with respect to the displacement amount of the piezoelectric elements 326, can range from 1 time to 20 times.

As shown in FIG. 3 and FIG. 8, thin sealing plates 328 are disposed at portions partitioned by both end portions of the nozzle plate 322, being the end portions of the nozzle plate 322 which is positioned in the longitudinal direction with respect to the direction of the row of the nozzle holes 324 arranged in a line, and by the end portions of the pair of frames 314 and are disposed in a state in which the respective thin sealing plates 328 are bonded to the pair of frames 314.

In order to prevent water leakage through the gaps between the longitudinal end portions of the nozzle plate 322 and the end portions of the pair of frames 314, and the sealing plates 328, the internal portions of the sealing plates 328 are filled with an elastic adhesive such as a silicone rubber adhesive or the like. Accordingly, without inhibiting the movements of the end portions of the nozzle plate 322, the gaps in the spray tank 312 may also be sealed with the elastic adhesive. Further, the end portions of the spray tank 312 can be sealed with caps formed from an elastic adhesive without using the thin sealing plates 328.

As described above, when power is supplied to the piezoelectric elements 326, as shown in FIG. 7, the piezoelectric elements 326 are extended so that the lever plates 320 are rotated around the supporting portions 312B. In accordance with this, the nozzle plate 322 is displaced while being deformed by the piezoelectric elements 326 such that the central portion of the nozzle plate 322 rises in the direction of arrow B. In accordance with the deformation of the nozzle plate 322, water pressure inside the spray tank 312 increases, and water droplets L comprising small amounts of water are sprayed linearly from the nozzle holes 324 at the same time.

By repeatedly supplying power to the piezoelectric elements 326 and by repeatedly extending the piezoelectric elements 326, water droplets L can be sprayed successively from the nozzle holes 324.

A bubble detecting means in the liquid spraying apparatus according to the present embodiment, and a control method thereof will be explained hereinafter. In this liquid spraying apparatus 508, during use of the image forming apparatus, the spray tank 312 is filled with water, and after the use of the image forming apparatus, water is drained from the spray tank 312, and while the image forming apparatus is not in use, the spray tank 312 stands by.

For this reason, at the start of using the image forming apparatus, the spray tank 312 is filled with water. However, if residual bubbles exist inside the spray tank 312, even when the piezoelectric elements 326 of the liquid spraying apparatus are driven and the nozzle plate 322 is thereby deformed, and the volume inside the spray tank 312 is reduced by a very small amount and water is thereby pushed out from the nozzle holes 324, residual bubbles existing inside the spray tank 312 collapse, and the very small amount by which the volume inside the spray tank 312 has been reduced due to the deformation of the nozzle plate 322 is thereby absorbed. As a result, because water droplets are not appropriately sprayed from the nozzle holes 324, atomization action in the liquid spraying apparatus may become unstable and uneven. In order to prevent this problem, a bubble detecting means is provided which detects whether residual bubbles exist inside the spray tank 312 in the liquid spraying apparatus. When the existence of residual bubbles has been detected, water is drained from the spray tank 312 by a residual bubble prevention and control means and the spray tank 312 is refilled with water. As a result, residual bubbles can be prevented from existing in the spray tank. For example, as shown in FIG. 3, each of the sealing plates 328 is formed by a transparent member such as a glass plate, a transparent plastic plate, a transparent acrylic plate or the like which is made from a transparent material. As the bubble detecting means, a monitoring camera such as a CCD camera or the like is provided (not shown) which transmits through the above-described sealing plates 328 and monitors the internal portion of the spray tank 312 by viewing from the side surface end openings of the spray tank 312 in the longitudinal direction thereof.

Immediately after the spray tank 312 has been filled with water, the internal portion of the spray tank 312 is photographed by the monitoring camera. The photographed image of the internal portion of the spray tank 312 is captured by an image processor such as a microcomputer or the like, is subjected to image processing, and detects the existence of residual bubbles. The detecting results of the existence of the residual bubbles are transmitted to the residual bubble prevention and control means which forms a part of the controller for controlling the liquid spraying apparatus.

Figure 4:
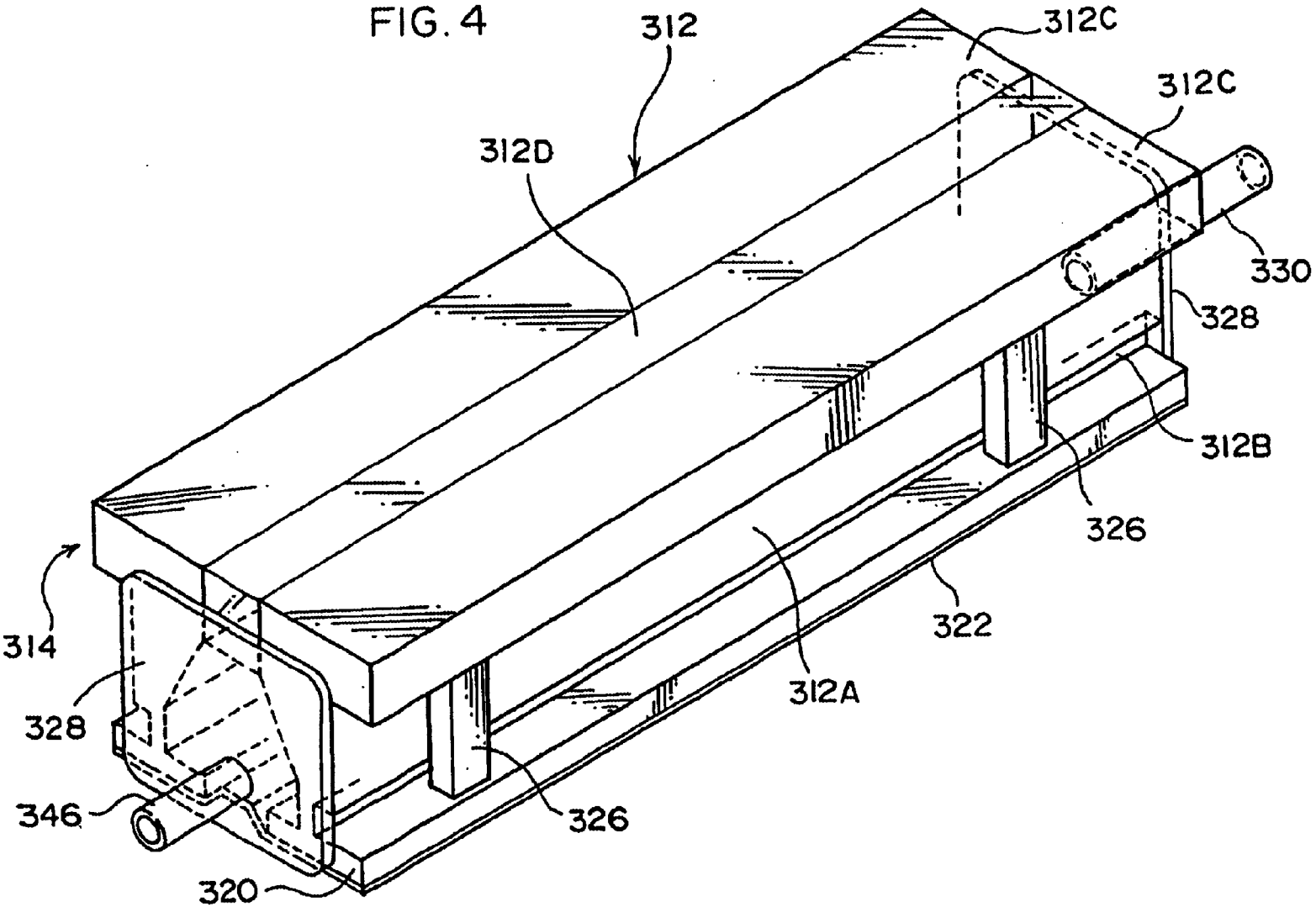
FIG. 4 is an enlarged perspective view of another example of the structure of the liquid spraying apparatus according to the present embodiment.

Any structure can be employed for the bubble detecting means as far as it can detect the existence of residual bubbles. For example, it can be structured as shown in FIG. 4. In the spray tank 312 which is shown in FIG. 4, a portion between the pair of topwalls 312C extending from the external side surface of the spray tank 312 to the internal side surface thereof into which water is supplied is made to be transparent. Namely, a transparent member 312D is made from glass, acrylic plastic or the like and is formed in a rectangular column shape. The transparent member 312D is disposed between the pair of topwalls 312C so as to be integrated therewith, corresponding to the groove portion 322A made up of the nozzle holes 324 which are arranged in a line, of the nozzle plate 312, and extending along the groove portion 322A.

While a monitoring camera 400 being moved from one end to the other end of the transparent member 312C in the longitudinal direction thereof, the internal portion of the spray tank 312 which has been filled with water can be photographed by scanning. The photographed image is fetched by an image processor, is subjected to image processing, and the existence of residual bubbles can be detected thoroughly.

In addition to the above-described structure, the bubble detecting means can be structured as described below.

Figure 10:
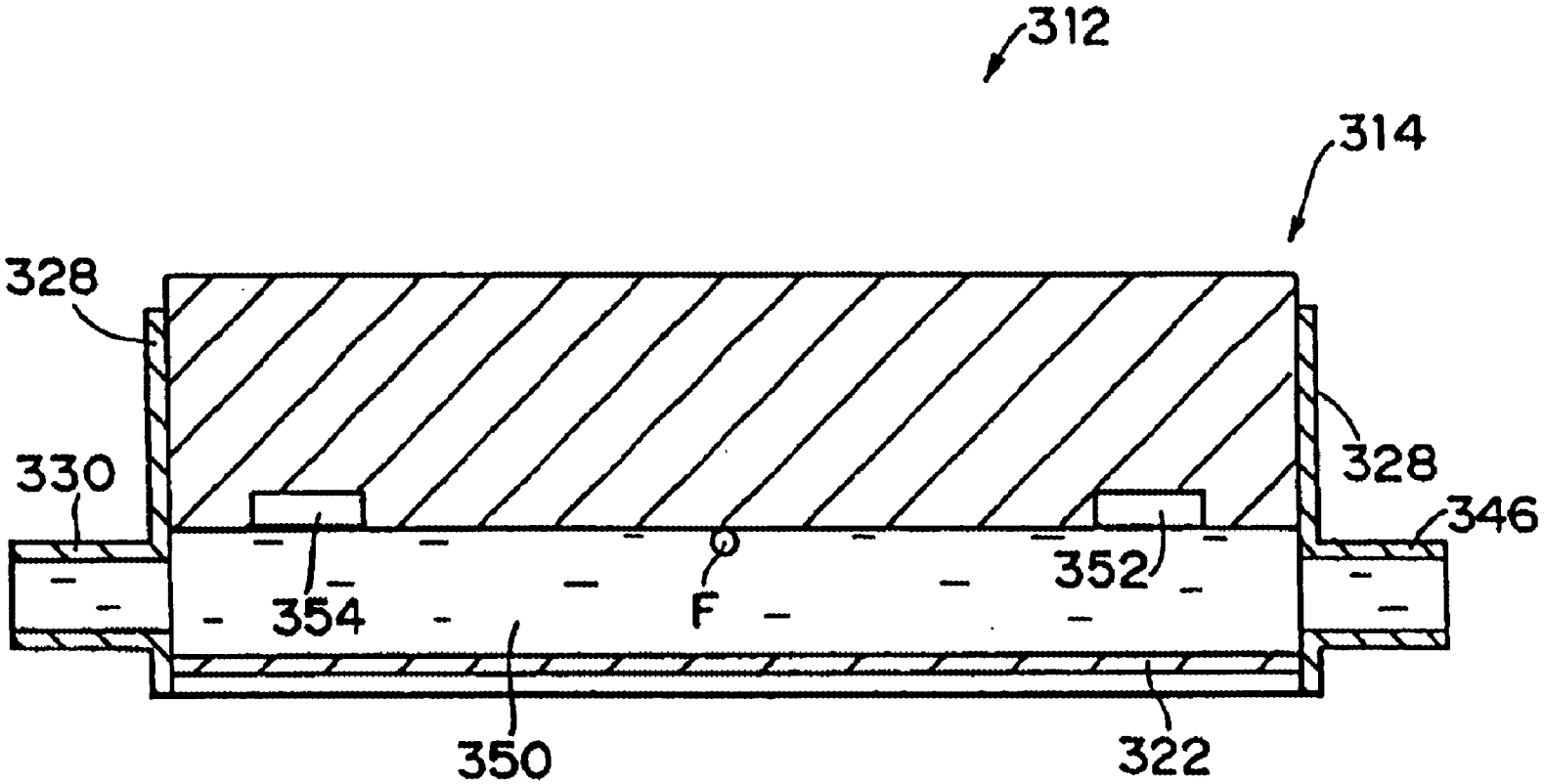
FIG. 10 is a schematic cross sectional explanatory view illustrating a first example of the structure of a bubble detecting means in the liquid spraying apparatus according to the present embodiment.

Firstly, in the spray tank 312 which is shown in FIG. 10, a pressurizing actuator 352, which pressurizes water with which a space 350 of the spray tank 312 is filled, is provided at a predetermined position facing the internal wall of the space 350 on the side nearest a water-supplying pipe 346 which is provided at one of the sealing plates 328 within the space 350 for storing water therein. Further, a pressure sensor 354 is disposed at a predetermined position which faces the internal wall of the space 350 on the side of the exhaust pipe 330 which is provided at the other of the sealing plates 328. Means which detects the existence of the bubble F is structured such that the change of the pressure indicated by the pressure sensor 354 (if there is a bubble F, the pressure decreases) is detected when water, with which the space 350 of the spray tank 312 is filled, is pressurized by the pressurizing actuator 352. Alternatively, means which detects the existence of the bubble F is structured such that the change of the propagation rate of the pressure is detected when water inside the space 350 is pressured by the pressurizing actuator 352.

Figure 11:
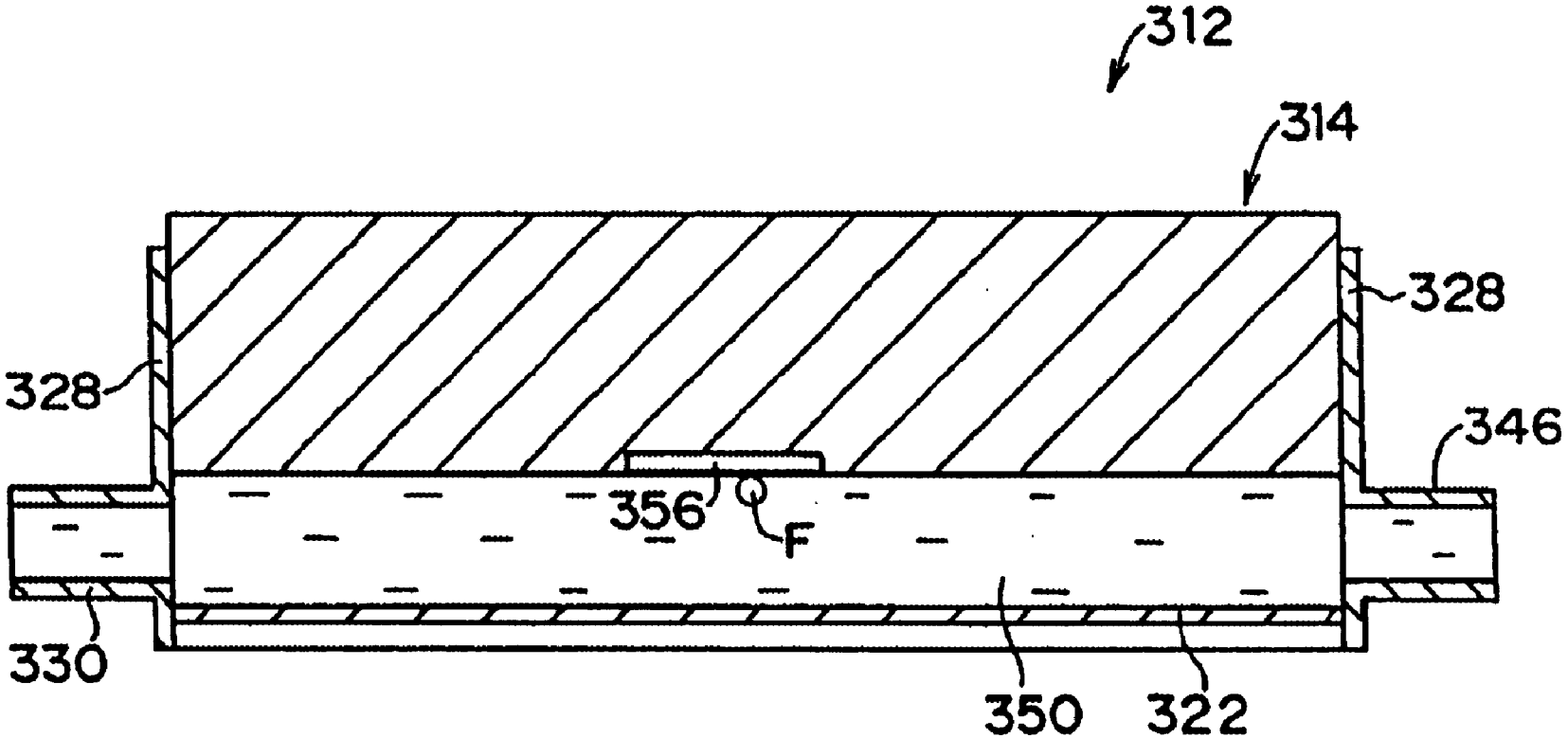
FIG. 11 is a schematic cross sectional explanatory view illustrating a second example of the structure of a bubble detecting means in the liquid spraying apparatus according to the present embodiment.

Secondly, in the spray tank 312 which is shown in FIG. 11, a pressure sensor 356 is provided at the longitudinal central portion in the space 350 which stores water therein, and faces the internal wall of the space 350. Alternatively, means which detects the existence of a bubble F is structured such that the nozzle plate 322 of the liquid spraying apparatus is driven and water with which the space 350 of the spray tank 312 is filled is pressurized, and the change of the pressure indicated by the pressure sensor which is attached to the wall surface within the space 350 which stores water therein is detected. Alternatively, means which detects the existence of the bubble F is structured such that the change of the propagation rate of the pressure is detected when the nozzle plate 322 is driven.

Figure 12:
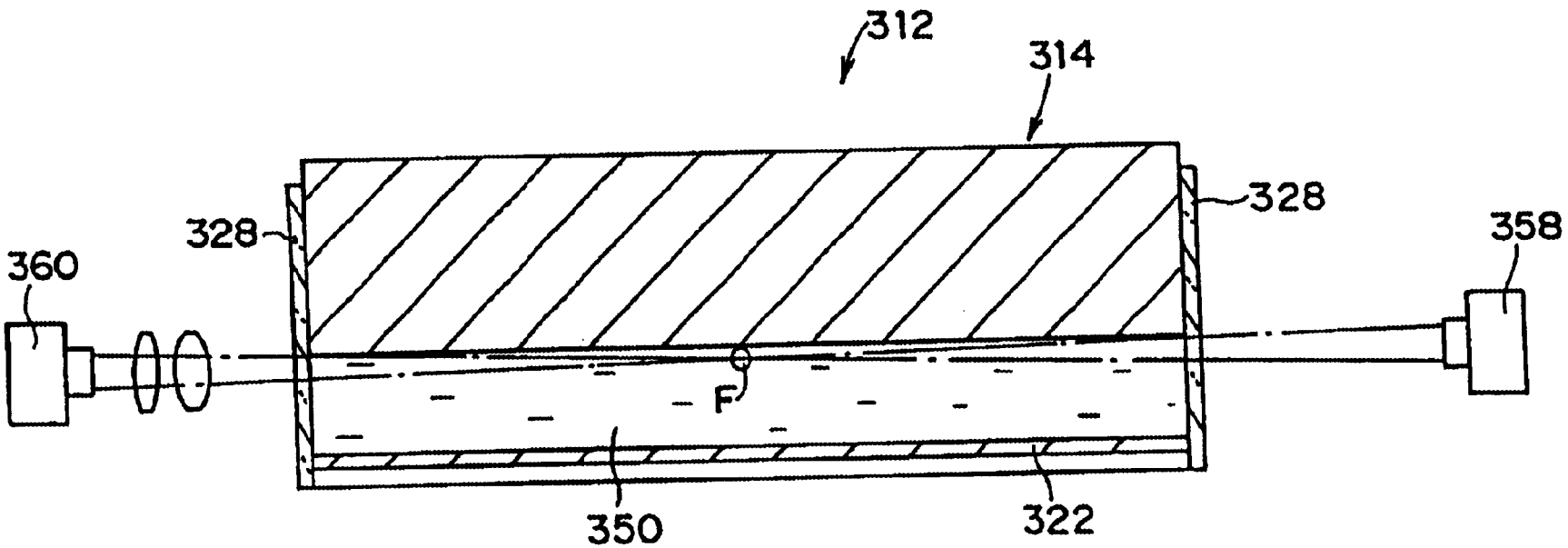
FIG. 12 is a schematic cross sectional explanatory view of a third example of the structure of a bubble detecting means in the liquid spraying apparatus according to the present embodiment.

Thirdly, in the spray tank 312 which is shown in FIG. 12, each of the sealing plates 328 which are disposed at the longitudinal end portions of the spray tank 312 is formed from a transparent member. A light emitting apparatus 358 is disposed at the side of one of the sealing plates 328, while a light receiving apparatus 360 is disposed at the side of the other. The entire internal portion of the space 350 of the spray tank 312 is scanned with light such as laser light or the like emitted from the light emitting apparatus 358 with no gaps. The amount of light when light such as laser light or the like is incident in the light receiving apparatus 360 is detected. When light such as laser light or the like which has been emitted by the light emitting apparatus 358 is transmitted through water with which the space 350 of the spray tank 312 is filled, if there is a bubble F, a light path is thereby blocked. The amount of the light received by the light receiving apparatus 360 is changed and thereby decreases. By making use of this change, means for detecting the existence of the bubble F is structured.

Figure 13:
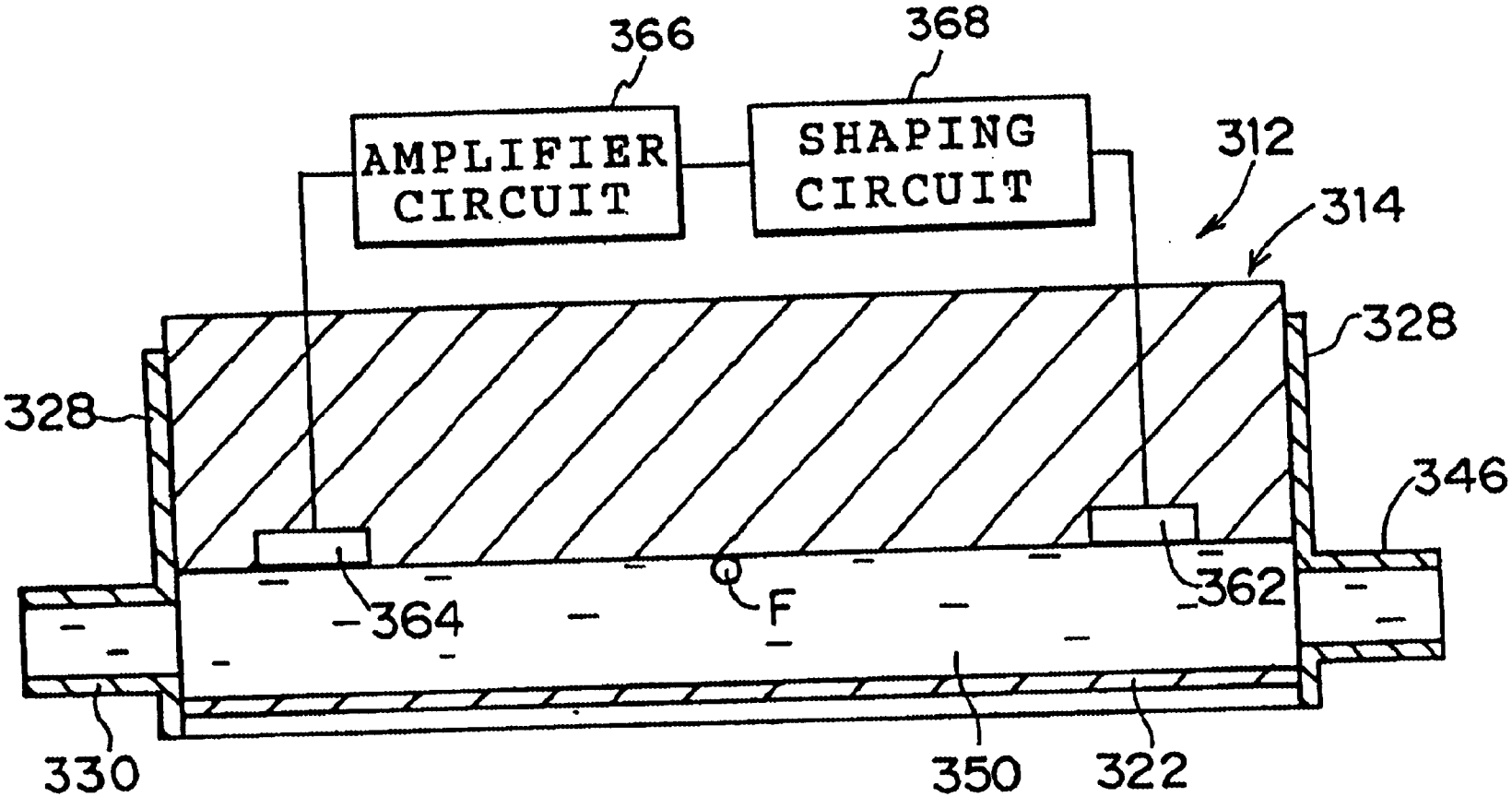
FIG. 13 is a schematic cross sectional explanatory view of a fourth example of the structure of a bubble detecting means in the liquid spraying apparatus according to the present embodiment.
Figure 14:
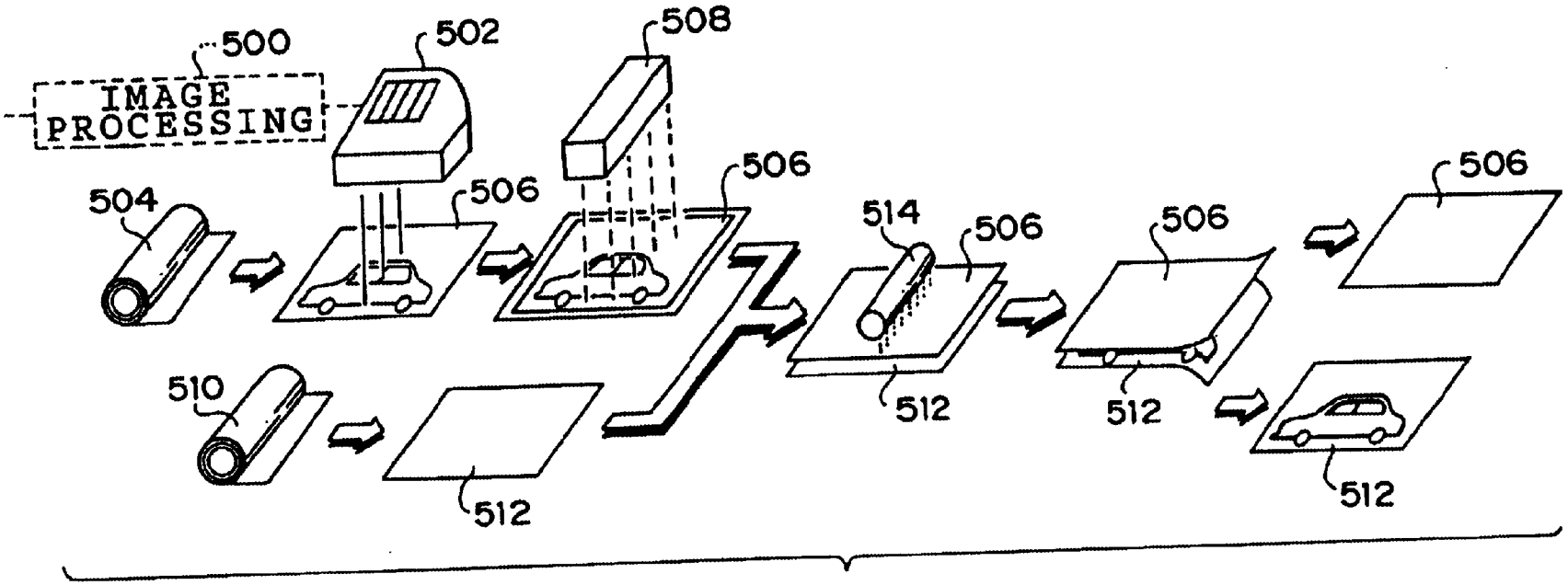
FIG. 14 is a view illustrating a treatment processes in an image recording apparatus having a conventional liquid spraying apparatus.

Fourthly, in the spray tank 312 which is shown in FIG. 13, a wave transmitting device 362 which transmits ultrasonic pulses into water with which the space 350 is filled is provided at a predetermined portion which faces the internal wall of the space 350 at the side of the water supplying pipe 346 in the space 350 which stores water therein. Further, in the spray tank 312, a wave receiving device 364 which receives ultrasonic pulses is provided at a predetermined portion which faces the internal wall of the space 350 at the side of the exhaust pipe 330 in the space 350 which stores water therein. Ultrasonic pulses are transmitted from the wave transmitting device 362 into the water with which the spray tank 312 is filled. Pulse waves received by the wave receiving device 364 are transmitted to an amplifier circuit 366 where they are amplified. Thereafter, the pulse waves which have been thus amplified are transmitted to a waveform shaping circuit 368 at which trigger pulses are generated. The wave transmitting device 362 is driven by the trigger pulses so as to generate ultrasonic pulses. By repeating this operation, the pulse intervals become a propagation time. As a result, means which detects the existence of the bubble F due to a change in the propagation time can be structured.

Fifthly, although it is not shown, means for detecting the existence of a bubble F may be structured such that a so-called "idle spray" in which the liquid spraying apparatus is driven and water with which the spray tank 312 is filled is sprayed onto portions except for the photosensitive material 16 is carried out, and the amount or state of water sprayed from the nozzle holes 324 is measured.

Figure 5:
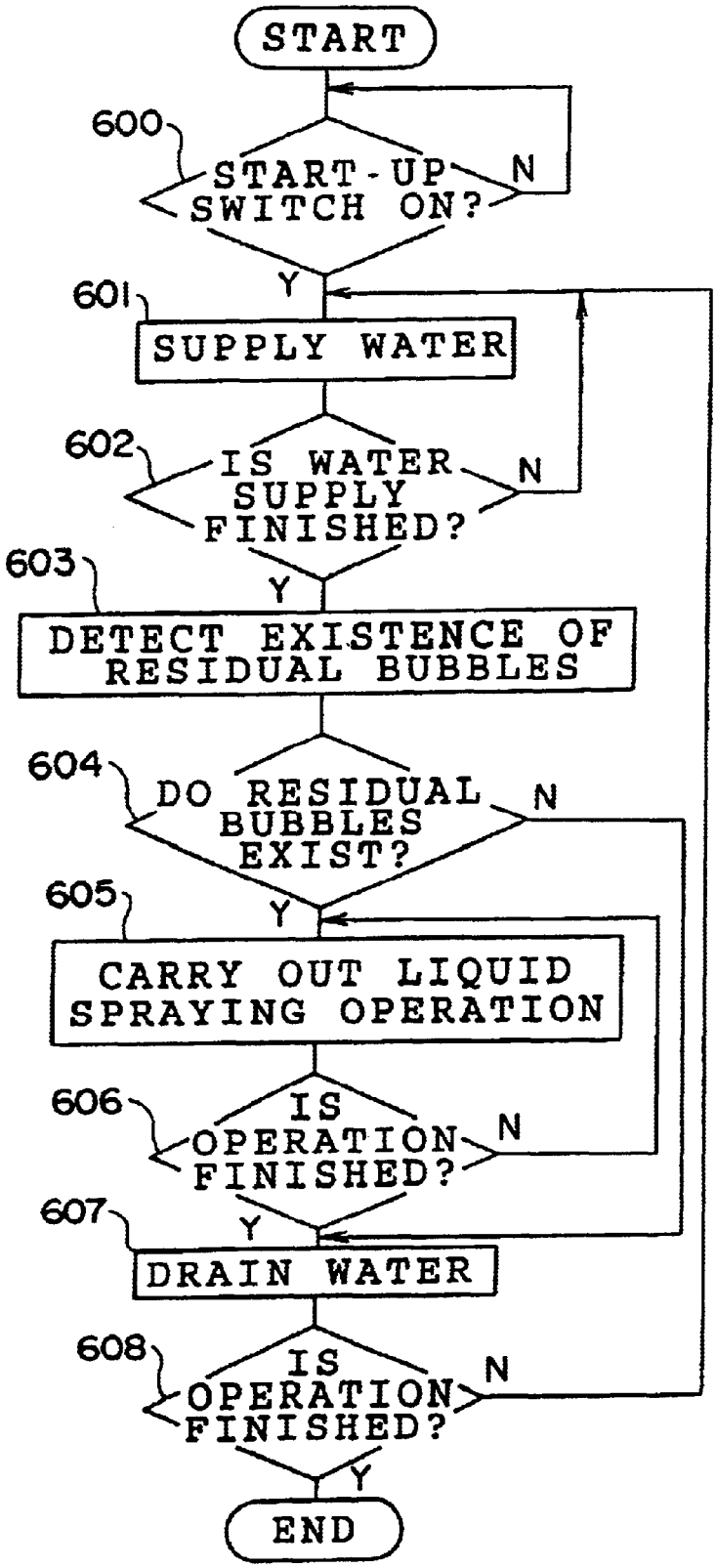
FIG. 5 is a flowchart which illustrates a control operation of a controller in the image recording apparatus having the liquid spraying apparatus according to the present embodiment.

On the basis of the results detected by such bubble detecting means as described above, the control operation of the residual bubble prevention and control means is carried out. The residual bubble prevention and control means is structured such that a control operation is carried out by a microcomputer or the like of the image recording apparatus in accordance with the procedures illustrated in the flowchart of FIG. 5.

Next, a description of the control operation will be given in accordance with the flowchart. In step 600, the routine waits until a start-up switch of the liquid spraying apparatus is on. When the start-up switch of the liquid spraying apparatus is switched on, the routine proceeds to step 601. In step 601, the operation in which the spray tank 312 is filled with water is carried out. Water is supplied until it is judged that water supply has been completed in next step 602. In this step 602, when water supply has been judged to be completed, the routine proceeds to step 603, where the bubble detecting means is operated. In step 604, on the basis of the detecting results, if it has been judged that bubbles do not exist in the spray tank 312, in step 605, the liquid spraying apparatus is driven. In step 606, water is sprayed onto the photosensitive material 16, and water is successively sprayed from the liquid spraying apparatus until it is judged that the operation of application has been completed. In step 606, when the application operation has been judged to be completed, the routine proceeds to step 607, where water is drained from the spray tank 312, and the routine proceeds to step 608.

In step 604, if it is judged that bubbles exist in the spray tank 312, the routine proceeds to step 607, where water is drained from the spray tank 312, and the routine proceeds to step 608.

In step 608, it is judged whether the operation of the liquid spraying apparatus has been completed. If it is judged that the operation by the liquid spraying apparatus has been completed, the start-up switch of the liquid spraying apparatus is switched off. The control operation is finished. If it is judged that the operation has not yet been completed, the routine is controlled to return to step 601.

As described above, in the residual bubble prevention and control means, after water has been supplied into the spray tank 312, when bubbles are detected by the bubble detecting means, an operation in which residual bubbles are drained out as the water being drained from the spray tank 312 and by the spray tank 312 being refilled with water is repeated until the residual bubbles are drained. Accordingly, residual bubbles are drained from the spraying tank 312, and water can be applied to the photosensitive material 16 appropriately without causing atomization failure.

As described above, the residual bubble prevention and control means is structured such that all the operations are controlled by a microcomputer. Also, the residual bubble prevention and control means can be structured such that a warning device separately prepared is operated by a signal indicating that the existence of residual bubbles has been detected by the bubble detecting means, and the user is informed of this, and water is drained from the spraying tank 312 and the spray tank 312 is refilled with water by the user, manually. The residual bubble prevention and control means is not limited to the one in which residual bubbles are removed by water being drained from the spray tank 312 or the spray tank 312 being refilled with water. For example, in order to drain residual bubbles from the spray tank, there is no problem in structuring the residual bubble prevention and control means by causing this means to automatically perform a control operation which comprises the steps of removing residual bubbles by tilting the spray tank body; removing residual bubbles by decreasing the pressure of the liquid with which the spray tank is filled; and removing residual bubbles by stirring the liquid with which the spray tank is filled.

On the other hand, as shown in FIG. 1, a photosensitive material magazine 106 which receives an image receiving material 108 is disposed at the upper left end portion of the housing 12. A dye fixing material having a mordant is applied to the image forming surface of this image receiving material 108. The image receiving material 108 is wound onto the image receiving material magazine 106 in the form of a roll such that the image forming surface of the image receiving material 108 which is pulled out from the image receiving material magazine 106 faces downward.

A pair of nip rollers 110 are disposed near an image receiving material output port in the image receiving material magazine 106. The nip rollers 110 are able to nip the image receiving material 108 and pull out the image receiving material 108 from the image receiving material magazine 106, and cancel the nipping.

A cutter 112 is disposed at the side of the nip rollers 110. In the same manner as the cutter 20 for the above-described photosensitive material, the cutter 112 is, for example, a rotary type cutter formed of a stationary blade and a moving blade. The cutter 112 can cut the image receiving material 108 which is pulled out from the image receiving material magazine 106 to a length which is shorter than the photosensitive material 16, by vertically moving the moving blade via a rotating cam or the like so as to mesh with the stationary blade.

Pairs of conveying rollers 132, 134, 136 and 138 and an unillustrated guide plate are disposed at the side of the cutter 112 so as to convey the image receiving material 108 which has been cut to a predetermined length, towards a heat developing and transferring section 120.

Figure 9:
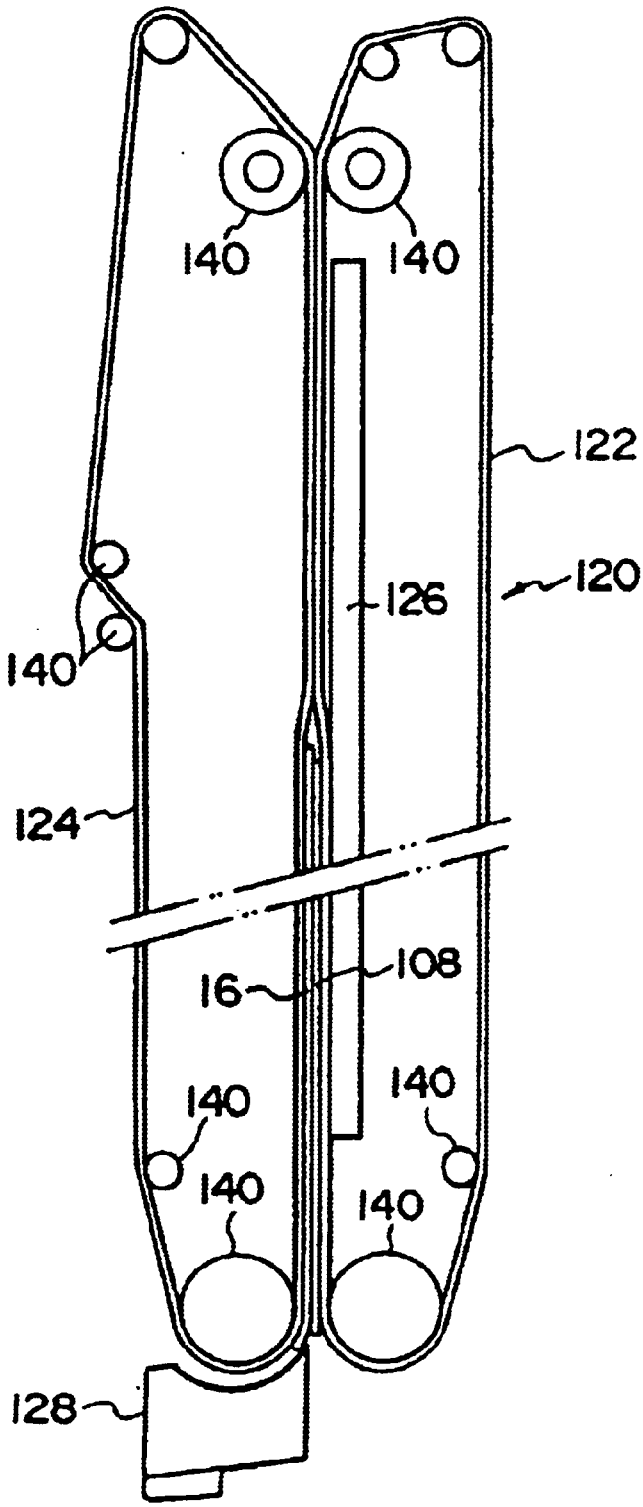
FIG. 9 is an enlarged view of a heat developing and transferring section in the image recording apparatus having the liquid spraying apparatus according to the present embodiment.

As shown in FIGS. 1 and 9, the heat developing and transferring section 120 has a pair of endless belts 122 and 124 each of which is entrained around a plurality of winding rollers 140 and is formed in a loop shape whose perpendicular direction is the longitudinal direction thereof. Accordingly, when one of the winding rollers 140 is driven and rotated, the pair of endless belts 122 and 124 which are entrained around these winding rollers 140 are thereby respectively rotated.

In a loop of the endless belt 122 at the right side in FIGS. 1 and 9 of the pair of endless belts 122 and 124, a heating plate 126, which is formed in a plate shape whose vertical direction is the longitudinal direction thereof, is disposed so as to face the internal peripheral portion at the left side of the endless belt 122. An unillustrated linear heater is provided at the internal portion of the heating plate 126. The surface of the heating plate 126 can be heated by this heater to a predetermined temperature.

Accordingly, the photosensitive material 16 is conveyed by the pair of conveying rollers 34 between the pair of endless belts 122 and 124 at the heat developing and transferring section 120 at the end of the conveying path. Further, the conveyance of the image receiving material 108 is synchronized with the conveyance of the photosensitive material 16. In a state in which the photosensitive material 16 is conveyed prior to the image receiving material 108 by a predetermined length, the image receiving material 108 is conveyed by the pair of conveying rollers 138 at the end of the conveying path into the pair of endless belts 122 and 124 at the heat developing and transferring section 120, and is laminated with the photosensitive material 16.

In this case, the image receiving material 108 has widthwise and lengthwise dimensions which are smaller than those of the photosensitive material 16. Accordingly, when the photosensitive material 16 is laminated with the image receiving material 108, the four sides of the periphery of the photosensitive material 16 project from those of the periphery of the image receiving material 108.

As described above, the photosensitive material 16 and the image receiving material 108 which have been laminated with each other are nipped and conveyed by the pair of endless belts 122 and 124 in a laminated state. When the laminated photosensitive material 16 and the image receiving material 108 have completely entered between the endless belts 122 and 124, the pair of endless belts 122 and 124 stop rotating temporarily, and the nipped photosensitive material 16 and the image receiving material 108 are heated by the heating plate 126. While the photosensitive material 16 is being nipped and conveyed, and also while it is stopped, it is heated by the heating plate 126 through the endless belt 122. As it is heated, the photosensitive material 16 discharges a movable dye. At the same time, the dye is transferred to a dye fixing layer of the image receiving material 108, and an image is formed on the image receiving material 108.

At the downstream side in the direction the material is fed, of the pair of endless belts 122 and 124, a peel-off pawl 128 is disposed. The peel-off pawl 128 engages the front edge portion of only the photosensitive material 16 out of the photosensitive material 16 and the image receiving material 108 which are nipped and conveyed between the pair of endless belts 122 and 124, and peels the front edge portion of the photosensitive material 16 which protrudes from between the pair of the endless belts 122 and 124, from the image receiving material 108.

At the left side of the peel-off pawl 128, photosensitive material discharging rollers 148 are disposed. The photosensitive material 16 is moved to the left by being guided by the peel-off pawl 128, and can be conveyed towards a discharged photosensitive material accommodating section 150.

The discharged photosensitive material accommodating section 150 has a drum 152 around which the photosensitive material 16 is entrained, and has a belt 154, a portion of which is entrained around the drum 152. The belt 154 is entrained around a plurality of rollers 156, and is conveyed through the rotation of the rollers 156. In accordance with this, the drum 152 can rotate.

In a state in which the belt 154 is moved due to the rotation of the rollers 156, when the photosensitive material 16 is fed into the rollers 156, the photosensitive material 16 can be collected around the drum 152.

In FIG. 1, image receiving material discharge rollers 162, 164, 166, 168, and 170 are disposed in this order so that the image receiving material 108 can be conveyed from the bottom of the pair of endless belts 122 and 124 in a downstream direction. The image receiving material 108 which is discharged from the pair of endless belts 122 and 124 is conveyed by the image receiving material discharge rollers 162, 164, 166, 168, and 170, and discharged into a tray 172.

Next, the operation of the present embodiment will be explained.

In the image recording apparatus 10 having the above-described structure, after the photosensitive material magazine 14 has been set, the pair of nip rollers 18 are operated and the photosensitive material 16 is pulled out by the nip rollers 18. When a predetermined length of the photosensitive material 16 is pulled out, the cutter 20 is operated, and the photosensitive material 16 is cut to a predetermined length, and is conveyed to the exposure section 22 in a state in which the photosensitive (exposure) surface is facing the left. The exposure device 38 is operated while the photosensitive material 16 passes through the exposure section 22, and an image is scanned and exposed to the photosensitive material 16 which is positioned at the exposure section 22.

When the exposure has been completed, the exposed photosensitive material 16 is fed to the water application section 50. In the water application section 50, as shown in FIG. 8, the conveyed photosensitive material 16 is fed towards the spray tank 312 by the driving of the conveying rollers 32.

The movement and operation of the photosensitive material 16 during which the photosensitive material 16 which is conveyed along the conveying path A is deposited with water from the spray tank 312 will now be explained.

This operation on the photosensitive material 16 is carried out by the residual bubble prevention and control means using the above-described bubble detecting means. As a previous operation for spraying water from the spray tank 312, the valve of the exhaust pipe 330 is set in a closed state by the controller. In this state, when water is atomized and sprayed, a voltage is applied to the piezoelectric elements 326 through a power source which is controlled by the controller so as to deform and extend all of the piezoelectric elements 326 simultaneously.

When the plurality of piezoelectric elements expand so as to all be extended at the same time, the pair of lever plates 320 are swung around the respective supporting portions 312B. Accordingly, the portion of the nozzle plate 322 surrounding the nozzle holes 324 positioned between the pair of lever plates 320 is reciprocated above the conveying path A in a direction facing the photosensitive material 16, and the nozzle plate 322 pressurizes the water inside the spray tank 312.

In this way, together with the movement of the piezoelectric elements 326, the water with which the spray tank 312 is filled is sprayed from the plurality of nozzle holes 324. As a result, as shown in FIG. 7, the water with which the spray tank 312 is filled is sprayed and atomized from the nozzle holes 324 and can be deposited on the photosensitive material 16 during the conveyance thereof.

At this point, together with the movement of the piezoelectric elements 326, the pair of lever plates 320 swing around their respective supporting portions 312B, which extend in the direction the plurality of nozzle holes 324 are arranged in a line. Further, the displacement of each of the lever plates 320 is adjusted due to the structure in which each of the piezoelectric elements 326 is disposed adjacent to the supporting portion 312B, and the end portions of the nozzle plate 322. Accordingly, the whole portion of the nozzle plate 322 having the plurality of nozzle holes 324 displaces substantially uniformly.

For this reason, all of the nozzle holes 324 can be displaced by the substantially same fixed displacement amount along the longitudinal direction in which the nozzle holes 324 are arranged in a line. The water with which the spray tank 312 is filled can be sprayed substantially uniformly from the plurality of nozzle holes 324. Accordingly, because the nozzle plate 322 is formed as the bottom wall surface of the spray tank 312, it is difficult for portions of the photosensitive material 16 to remain untouched by water.

The nozzle plate 322 is formed by a thin plate member. The groove portion 322A extending in the direction the plurality of nozzle holes 324 are arranged linearly is formed so as to be bent.

Since the nozzle plate 322 is structured by a thin plate member having the groove portion 322A, while the rigidity of the nozzle plate 322 in a direction the plurality of nozzle holes 324 are arranged in a line is being maintained, low rigidity can be provided for the nozzle plate 322, and the vibration amplitude needed for the nozzle holes 324 can be ensured. As a result, the operation of atomization by the application device 310 becomes stable, and the water with which the spray tank 312 is filled is reliably sprayed from the plurality of nozzle holes 324.

Further, since the nozzle plate 322 is structured by the thin plate member, when the application device 310 is manufactured, small nozzle holes 324 having a uniform size can be formed in the nozzle plate 322.

Since the spray tank 312 has the nozzle holes 324 from which water is sprayed, as compared to an application device in which a photosensitive material or the like has water applied thereto by being immersed into water stored in a reservoir, the application device according to the present invention is able to apply a minimum amount of water. Accordingly, the photosensitive material or the like can be dried in a short period of time.

The spray tank 312 has the plurality of nozzle holes 324 which are disposed over the entire portion in the widthwise direction of the photosensitive material 16. Through one displacement of the plurality of nozzle holes 324 by the piezoelectric elements 326, water can be sprayed from these nozzle holes 324 simultaneously. Accordingly, through one spraying, water can be applied to a broad range of the photosensitive material 16. For this reason, it becomes unnecessary to scan the nozzle plate 322 on a two dimensional plane and water can be applied to a large area of the photosensitive material 16 in a short period of time, thereby minimizing the application time.

Since a plurality of nozzle holes 324 are simply formed on the nozzle plate 322, an integration technique for nozzle holes is not needed. As a result, the application device 310 can be manufactured inexpensively In combination with the speed at which the photosensitive material 16 is conveyed, water can be applied to the entire surface of the photosensitive material 16 by spraying water from the nozzle holes 324 for a multiple number of times at an arbitrary timing. When water is sprayed from the nozzle holes 324 of the nozzle plate 322, the amount of water within the spray tank 312 gradually decreases. However, because a sub tank 338 can supply water into the spray tank 312 and maintain the water in the spray tank 312 at a constant level, water is supplied from the sub tank 338 to the spray tank 312, and the water pressure in the spray tank 312 during atomization can be maintained at a constant value. Accordingly, a continuous spray of water can be maintained.

Thereafter, the photosensitive material 16, to which water as an image forming solvent has been applied at the water application section 50, is conveyed by the pair of conveying rollers 34 between the pair of the endless belts 122 and 124 in the heat developing and transferring section 120.

As an image is scanned and exposed to the photosensitive material 16, the image receiving material 108 is pulled out from the image receiving material magazine 106 and conveyed by the pair of nip rollers 110. When a predetermined length of the image receiving material 108 is pulled out, the cutter 112 is operated and the image receiving material 108 is cut to a predetermined length.

After the cutter 112 has been operated, the cut image receiving material 108 is conveyed by the conveying rollers 132, 134, 136, and 138, while the cut image receiving material 108 is being guided by a guide plate. When the front edge portion of the image receiving material 108 is nipped by the conveying rollers 138, the image receiving material 108 is set in a stand-by state just before the heat developing and transferring section 120.

As described above, as the photosensitive material 16 is conveyed by the conveying rollers 34 into the endless belts 122 and 124, the conveyance of the image receiving material 108 is started again, and the image receiving material 108 and the photosensitive material 16 are conveyed between the pair of endless belts 122 and 124 so as to be integrated with each other.

As a result, the photosensitive material 16 and the image receiving material 108 are laminated with each other, and nipped and conveyed while being heated by the heating plate 126. Accordingly, a heat developing and transferring process is carried out, and an image is formed on the image receiving material 108.

When the photosensitive material 16 and the image receiving material 108 are discharged from the pair of endless belts 122 and 124, the peel-off pawl 128 engages with the front edge portion of the photosensitive material 16 which is conveyed ahead of the image receiving material 108 by a predetermined length and the leading edge of the photosensitive material 16 is peeled away from the image receiving material 108. The photosensitive material 16 is also conveyed by the photosensitive material discharging rollers 148 and is collected in the discharged photosensitive material accommodating section 150. At this time, since the photosensitive material 16 dries immediately, there is no need to provide a heater or the like in order to dry the photosensitive material 16.

The image receiving material 108 which has been separated from the photosensitive material 16 is conveyed by the image receiving material discharging rollers 162, 164, 166, 168, and 170 and output to the tray 172.

When a plurality of images are recorded on an image recording material through an image recording process, the processes described as above are sequentially carried out.

As described above, the image receiving material 108, which has been nipped by the pair of endless belts 122 and 124 and has been subjected to the heat developing and transferring process, and on which a predetermined image has been formed (recorded) is output from the pair of endless belts 122 and 124. Thereafter, the image receiving material 108 is nipped and conveyed by the image receiving material discharging rollers 162, 164, 166, 168, and 170 and is taken out from the image recording apparatus.

In the present embodiment, the row of nozzle holes are arranged along a line orthogonal to the direction in which the photosensitive material is conveyed, however, the row of nozzle holes may be arranged in a direction other than orthogonal, for example, they may be arranged diagonally to the direction in which the photosensitive material is conveyed.

In accordance with the above-described embodiment, the photosensitive material 16 and the image receiving material 108 are used as an image recording material. Water is applied to the photosensitive material 16, after the exposure thereof, by the spray tank 312 of the application device 310. The photosensitive material 16 and the image receiving material 108 are laminated onto each other and are subjected to the heat developing and transferring process. However, the structure is not limited to the same, and water may be applied by spraying to the image receiving material 108.

An image recording material according to the present invention is not limited to the materials used in the above described embodiments. Sheet type or roll type materials can be used where suitable. The image forming solvent may be a solvent other than water. Moreover, the present invention can be employed for the application of a developer to printing paper in a developing machine, the application of dipping water in a printer, and in coating machines or the like.

As described above, in accordance with the liquid spraying apparatus of the present invention, it is possible to obtain the superior effect in which, when a reservoir having a nozzle plate is filled with a liquid, the internal portion of the reservoir is not deposited with residual bubbles and atomization failure can be prevented.

What is claimed is:

1. A liquid spraying apparatus in which a nozzle plate is provided at a portion of a lower wall surface of a spray tank which stores a liquid therein, the nozzle plate has a row of nozzles made up of a plurality of nozzle holes through which the liquid is sprayed when the nozzle plate is reciprocated, comprising:

at least a portion of the spray tank being formed from a transparent member;

a monitoring camera which views an internal portion of said spray tank from at least a side end wall surface of said spray tank, through said transparent member;

wherein said internal portion of said spray tank is photographed by said camera to determine an existence of residual bubbles in said spray tank.

2. A liquid spraying apparatus comprising:

a nozzle plate provided at a portion of a lower wall surface of a spray tank which stores a liquid therein, the nozzle plate having a row of nozzles made up of a plurality of nozzle holes through which the liquid is sprayed when the nozzle plate is reciprocated;

bubble detecting means which, when said spray tank is filled with the liquid, detect whether or not residual bubbles exist inside said spray tank;

residual bubble prevention and control means which, when receiving a signal indicating that an existence of residual bubbles has been detected by said bubble detecting means, carries out a control operation in which the liquid with which said spray tank is filled is drained, and said spray tank is refilled with a liquid.

3. A liquid spraying apparatus according to claim 2, wherein said residual bubble prevention and control means is a control operation which removes the residual bubbles by decreasing the pressure of the liquid with which said spray tank is filled.

4. A liquid spraying apparatus in which a nozzle plate is provided at a portion of a lower wall surface of a spray tank which stores a liquid therein, the nozzle plate has a row of nozzles made up of a plurality of nozzle holes through which the liquid is sprayed when the nozzle plate is reciprocated, comprising:

a bubble detecting means which, when said spray tank is filled with the liquid, detects whether or not residual bubbles exist inside said spray tank; and residual bubble prevention and control means which, when receiving a signal indicating that an existence of residual bubbles has been detected by said bubble detecting means, drains said residual bubbles;

wherein said bubble detecting means detects the existence of residual bubbles by monitoring the internal portions of said spray tank by using a monitoring camera, at least one portion of said spray tank being formed from a transparent member, and said monitoring camera viewing an internal portion of said spray tank from at least a side end wall surface of said spray tank, through said transparent member.

5. A liquid spraying apparatus in which a nozzle plate is provided at a portion of a lower wall surface of a spray tank which stores a liquid therein, the nozzle plate has a row of nozzles made up of a plurality of nozzle holes through which the liquid is sprayed, is reciprocated, comprising:

a bubble detecting means which, when said spray tank is filled with the liquid, detects whether or not residual bubbles exist inside spray tank; and residual bubble prevention and control means which, when receiving a signal indicating that an existence of residual bubbles has been detected by said bubble detecting means, carries out a control operation in which the liquid with said spray tank is filled is drained, and said spray tank is refilled with a liquid;

wherein said bubble detecting means detects the existence of residual bubbles by monitoring the internal portions of said spray tank by using a monitoring camera, at least one portion of said spray tank being formed from a transparent member, and said monitoring camera viewing an internal portions of said spray tank from at least a side end wall surface of said spray tank, through said transparent member.

* * * * *